United States Patent [19]

Zocher

[11] 4,386,697

[45] Jun. 7, 1983

[54] NEEDLE PACK

[75] Inventor: Josef Zocher, Aachen, Fed. Rep. of Germany

[73] Assignee: The Singer Company, Stamford, Conn.

[21] Appl. No.: 48,425

[22] Filed: Jun. 14, 1979

[51] Int. Cl.[3] ..... B65D 85/28

[52] U.S. Cl. ..... 206/383; 206/382; 206/497; 206/346; 53/397

[58] Field of Search ..... 206/380, 382, 383, 346, 206/347, 497; 53/397

[56] References Cited

U.S. PATENT DOCUMENTS

| | | | |
|---|---|---|---|
| 259,018 | 6/1882 | Howard | 206/383 |
| 1,634,096 | 6/1927 | Doscher | 206/382 |
| 2,111,265 | 3/1938 | Heckel | 206/382 |
| 2,126,444 | 8/1938 | Bollinger, Jr. | 206/383 |
| 3,331,499 | 7/1967 | Jost | 206/380 |

FOREIGN PATENT DOCUMENTS

| | | | |
|---|---|---|---|
| 570468 | 9/1958 | Belgium | 206/380 |
| 1236064 | 6/1960 | France | 206/382 |
| 182733 | 12/1957 | Sweden | 206/380 |
| 426459 | 6/1967 | Switzerland | 206/382 |
| 1919 | of 1898 | United Kingdom | 206/383 |
| 25763 | of 1913 | United Kingdom | 206/383 |

*Primary Examiner*—Joseph Man-Fu Moy

*Attorney, Agent, or Firm*—Robert E. Smith; Edward L. Bell

[57] ABSTRACT

A relatively rigid needle pack comprising only a web of flexible material and a plurality of sewing machine needles arranged in groups of from about 3 to about 25 with their shank portions parallel and contiguous one another and the blade portion of each of the plurality of needles pierces the web to define a line of concatenated fenestrations. The web is wrapped tightly around the needle shank portions to secure the shank portions closely together forming a relatively rigid strip package containing about 3 to about 25 needles per strip. The web may be severed between groups of needles, forming separate packages or a plurality of groups of needles may be retained in a single uninterrupted web for multiple unit packaging.

14 Claims, 26 Drawing Figures

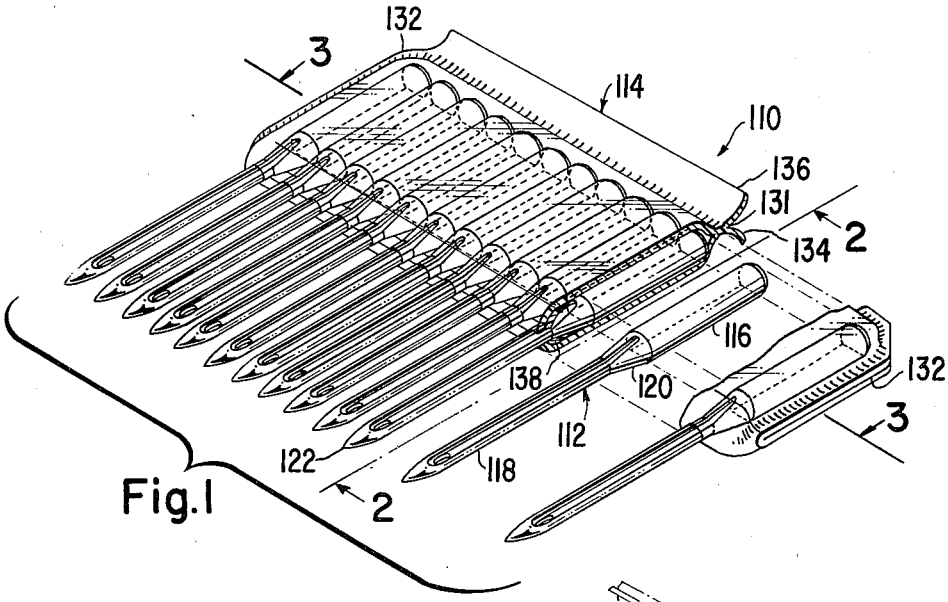
Fig.1
Fig.2
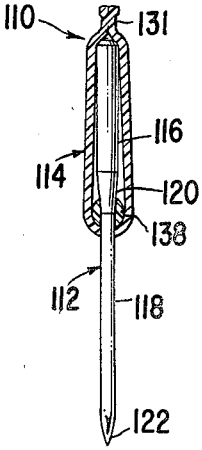
Fig.3
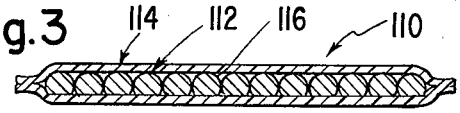
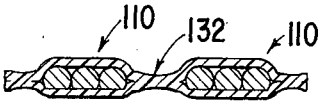
Fig.5
Fig.4
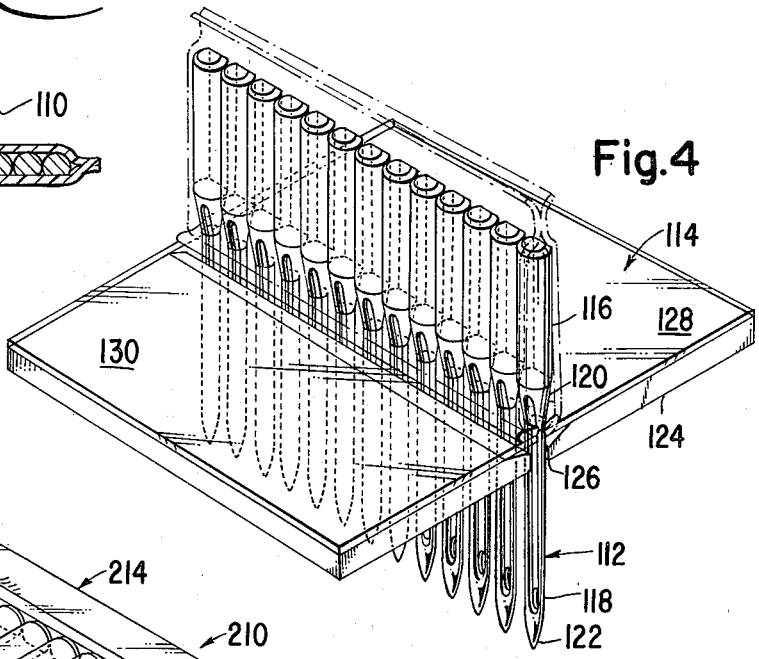
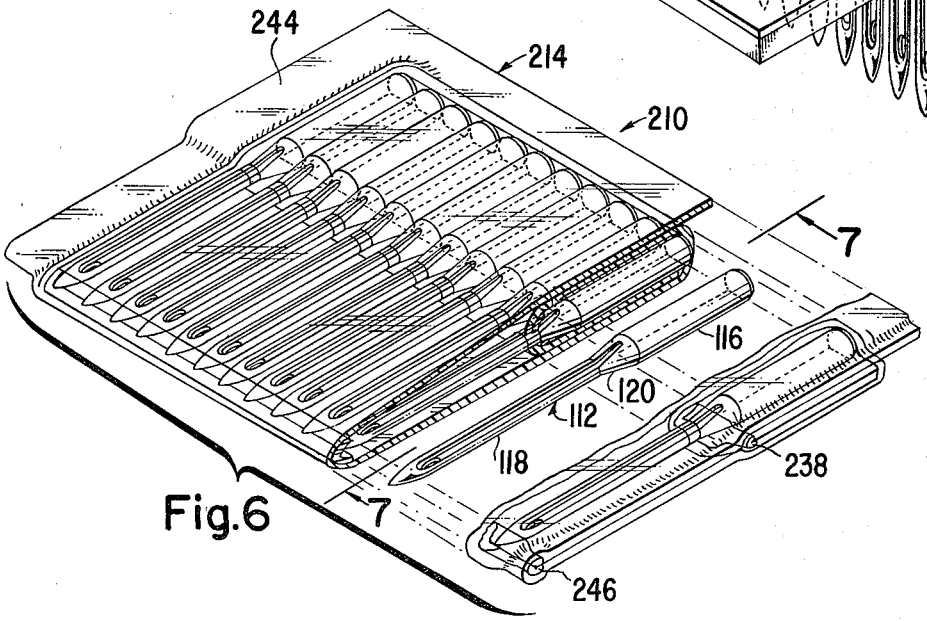
Fig.6
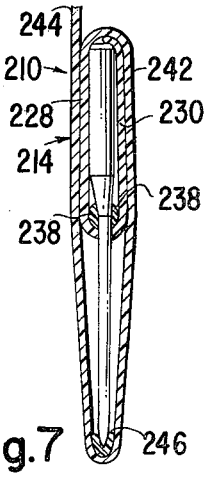
Fig.7

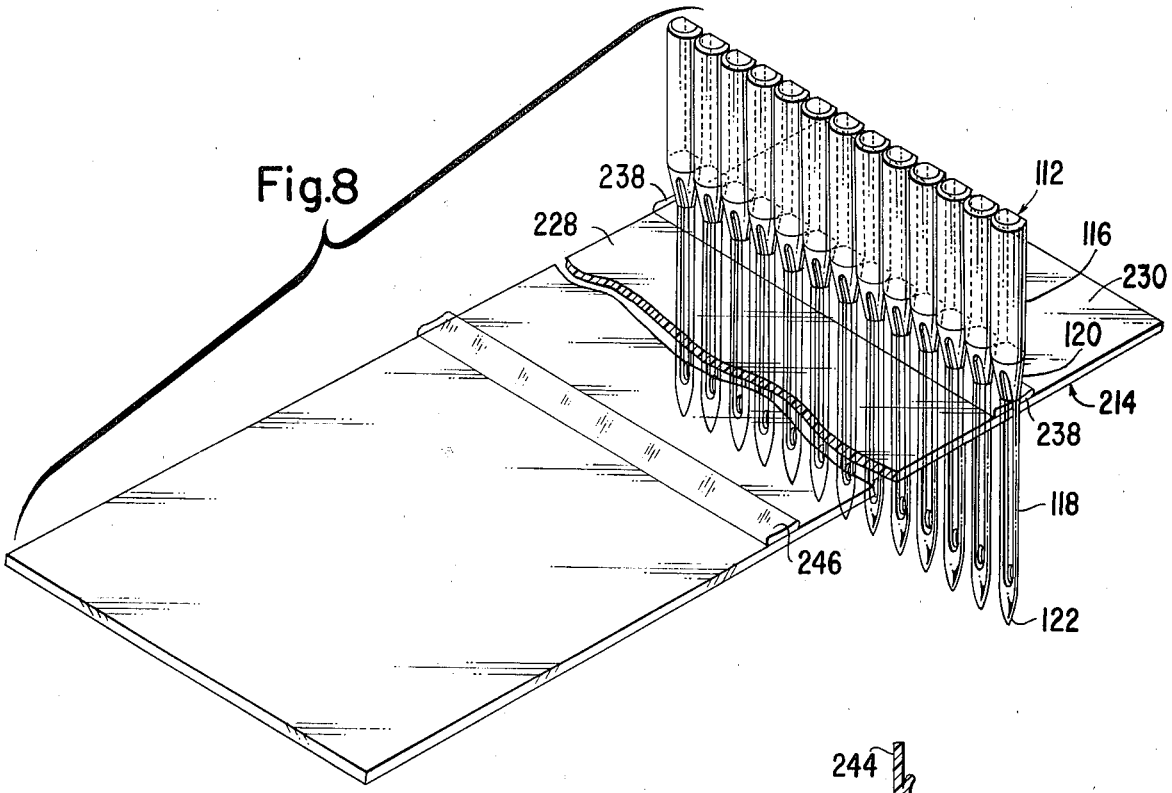
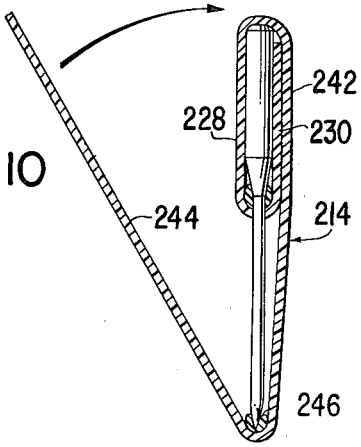
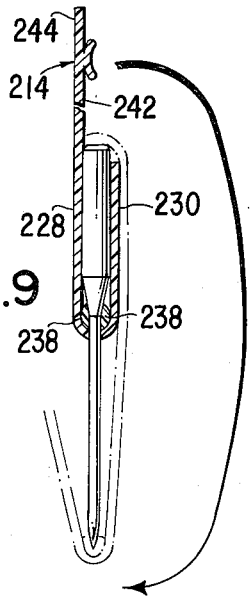
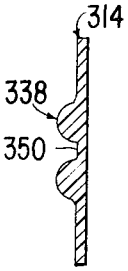
Fig.11
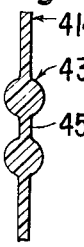
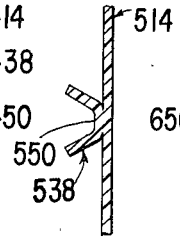
Fig.13
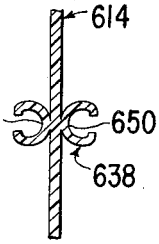
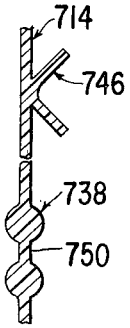
Fig.15
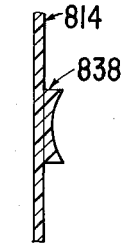
Fig.16
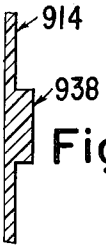
Fig.17

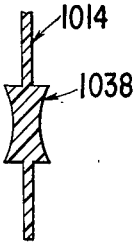
Fig.18
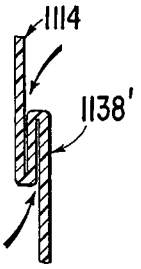
Fig.19
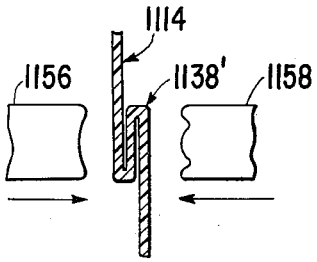
Fig.20
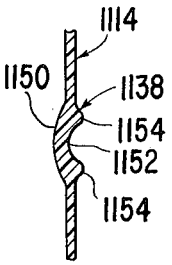
Fig.21
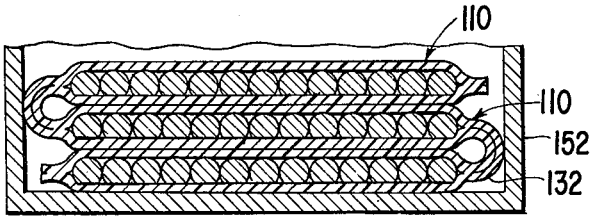
Fig.22
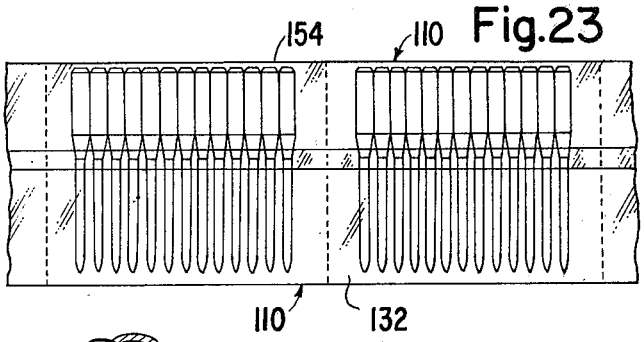
Fig.23
Fig.24
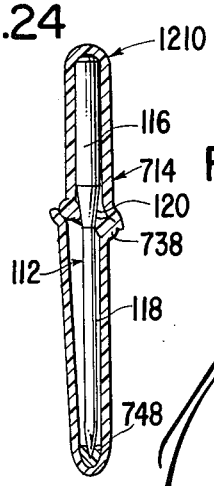
Fig.26
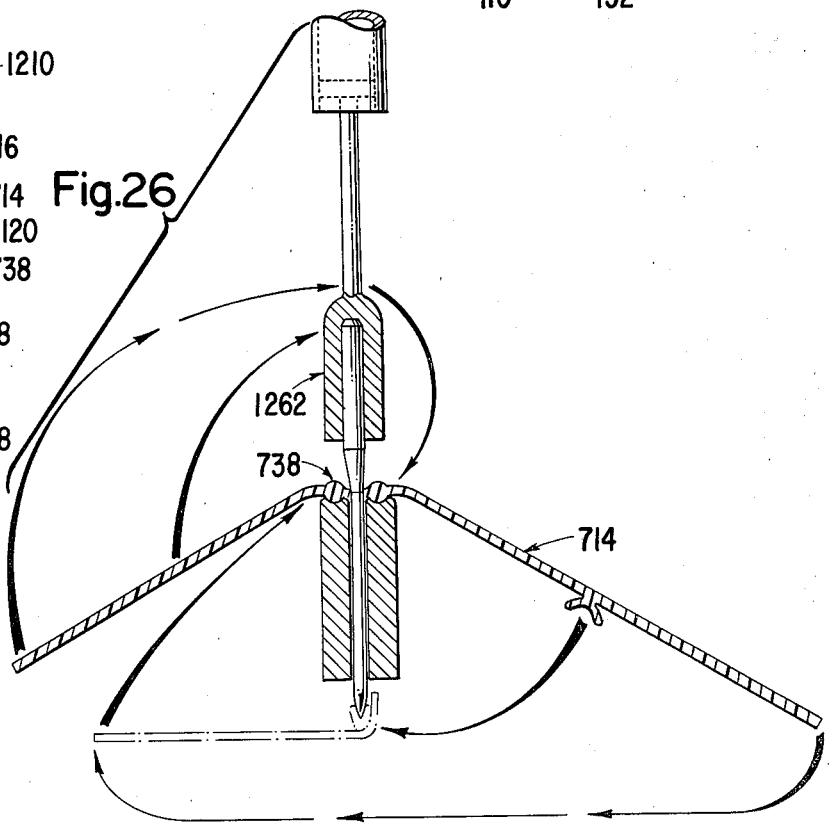

NEEDLE PACK

FIELD OF THE INVENTION

The instant invention relates to packaging, and more particularly to multi-unit packaging of elongated slender objects such as sewing machine needles.

BACKGROUND OF THE INVENTION

Present techniques for packaging sewing machine needles permit only a limited amount of automation of the packaging process. The packaging type most widely used for industrial sewing machine needles is a box packed with varying quantities of needles, 100 being a typical quantity. However, advantages would accrue to users of industrial needles if the needles could economically be packed in small quantities, e.g., 5 to 10 enabling better cost control and easier distribution at the user's sewing facilities. For household sewing machine needles, blister packs (cards) and small container packs have been used, with each pack containing about 3–10 needles. For both household and industrial sewing machine needle packaging, a number of handling operations as well as counting and controlling functions are required, only some of which are performed by means of mechanized equipment. The blister packaging of household needles is the most expensive form of packaging, in view of the high labor and material costs involved and the need to still manually handle the needles until packed. Blister packs are suited primarily for a high priced market, yet they have the essential disadvantages of not being reusable or suitable for placement into the attachment box of the household sewing machine during the time of actual use.

OBJECTS OF THE INVENTION

Bearing in mind the foregoing, it is a primary object of the present invention to provide novel and improved methods and apparatus for packaging, especially of sewing machine needles, and novel and improved needle packs in accordance therewith.

Another primary object of the present invention, in addition to each of the foregoing objects, is the provision of novel and improved methods and apparatus for providing substantially rigid packages of from about 3 to about 25 and preferably from about 5 to about 10 sewing machine needles or similar objects achieved through a novel cooperation of the needles themselves and substantially flexible or flaccid web material.

Yet another primary object of the present invention, in addition to each of the foregoing objects, is the provision of novel and improved methods of and apparatus for packaging and packages in accordance therewith especially for sewing machine needles, or the like, which are economic, substantially automatic, and substantially continuous in operation.

Still another primary object of the present invention, in addition to each of the foregoing objects, is provision of such novel and improved methods, apparatus, and packages which utilize a minimal amount of packaging material, but which are yet reusable and provide protection for the needles.

Yet still another primary object of the present invention, in addition to each of the foregoing objects, is the provision of novel methods, apparatus and packages of the class described, of continuous web form with the needles being in groups of from about 3 to about 25 and preferably from about 5 to about 10 spaced apart along a continuous web whereby the web can be severed between individual groups of needles to provide individual multiple unit packs of from about 3 to about 25 needles or the web may be left unsevered between several groups of needles providing multiple group packages of, for example, 100 needles or the web can be weakened between the groups of needles for separation by the user, retailer, consumer, or the like.

Yet another and still further primary object of the present invention, in addition to each of the foregoing objects, is the provision of such novel methods, apparatus and packages whereby long, slender objects, such as sewing machine needles may be efficiently and economically stored, handled and distributed.

Another and yet still further primary object of the present invention, in addition to the foregoing objects, is the provision of such novel methods, apparatus and packages whereby slender elongated objects, such as sewing machine needles may be wrapped so as to be protected during handling, storage and distribution.

Yet another and still further primary object of the present invention, in addition to each of the foregoing objects, is the provision of novel and improved methods, apparatus and packages for long, slender objects such as sewing machine needles providing relatively rigid packaging for groups thereof utilizing only normally flaccid or flexible web materials.

The invention resides in the combination, construction, arrangement and disposition of the various component parts and elements incorporated in new and improved packages, packaging, apparatus and packaging methods in accordance with the principles of this invention. The present invention will be better understood and objects and important features other than those specifically enumerated above will become apparent when consideration is given to the following details and description which, when taken in conjunction with the annexed drawing describes, discloses, illustrates and shows certain preferred embodiments or modifications of the present invention and what is presently considered and believed to be the best mode of practicing the principles thereof. Other embodiments or modifications may be suggested to those having the benefit of the teachings herein, and such other embodiments or modifications are intended to be reserved, especially as they fall within the scope and spirit of the subjoined claims.

SUMMARY OF THE INVENTION

The instant invention overcomes the aforementioned problems by providing a low cost, universal needle pack which offers advantages regarding distribution and storing of needles, and allows a maximum of mechanization in the packaging process.

This invention provides a relatively rigid needle pack comprising only a web of flexible material and a plurality of sewing machine needles. Each of the needles has a generally cylindrical shank portion and a blade portion. The needles are arranged in groups of from about 3 to about 25 with their shank portions parallel and contiguous one another and the blade portion of each of the plurality of needles pierces the web, for example, to the juncture of the blade portion with the shank portion to define a line of concatenated fenestrations. The web is wrapped tightly around the needle shank portions to secure the shank portions closely together forming a relatively rigid strip package containing about 3 to about 25 needles per strip. The web may be severed between groups of needles, forming separate packages or a plurality of groups of needles may be retained in a single uninterrupted web for multiple unit packaging. The web may be weakened between groups of needles for easier separation by the user. A longitudinally extensive reinforcing rib or ribs may be provided on the web at or adjacent the line of concatenated fenestrations whereat the needles pierce the web and the blade portions of the needles may also be wrapped by the web if desired. For consumer marketing, as opposed to industrial users, the groups of needles preferably comprise from about 5 to about 10 needles per plurality or group.

DESCRIPTION OF THE DRAWING

While the specification concludes with claims particularly pointing out and distinctly claiming the subject matter which is regarded as forming the present invention, it is believed the invention will be better understood from the following detailed description when taken in conjunction with the annexed drawing which discloses, illustrates and shows certain preferred embodiments or modifications of the present invention and what is presently considered and believed to be the best mode of practicing the principles thereof and wherein:

FIG. 1 is a perspective view, partially broken away, of a needle pack according to the instant invention;

FIG. 2 is a rotated sectional view taken on the vertical plane indicated by the line 2—2 of FIG. 1;

FIG. 3 is a sectional view taken on the vertical plane indicated by the line 3—3 of FIG. 1;

FIG. 4 is a schematic perspective illustration indicating a method of formation of the package of FIG. 1;

FIG. 5 is a cross-sectional illustration similar to FIG. 3 but illustrating how multiple numbers of smaller groups or pluralities of needles may be serially arranged in a continuous web;

FIG. 6 is a perspective view, similar to FIG. 1, partially broken away of another needle pack according to the instant invention;

FIG. 7 is a rotated sectional view taken on the vertical plane indicated by the line 7—7 of FIG. 6;

FIG. 8 is a perspective illustration indicating a step in the method of producing the package of FIG. 6;

FIG. 9 is a cross-sectional view similar to FIG. 7 of the web and needles of the package of FIG. 6 showing a further step in the fabrication of the package of FIG. 6;

FIG. 10 is a cross-sectional view similar to FIG. 9 showing a yet further step in the fabrication of the package of FIG. 6;

FIGS. 11–18, inclusive, are cross-sectional views of various webs that may be used to form the needle packs of the instant invention;

FIGS. 19–21, inclusive, are cross-sectional illustrations of yet another web showing steps in a method of reforming or molding a plain, flat web to define a rib therein for use in the manufacture of needle packs of the present invention;

FIG. 22 is a cross-sectional illustration through a box containing a plurality of needle pack groups of the present invention, serially arranged in a single continuous web and Z-folded within the box;

FIG. 23 is a plan illustration of a section of web containing a plurality of grouped needles packaged in accordance with the present invention with the web being weakened between serially adjacent groups of needle packs for easier user separation;

FIG. 24 is a cross-sectional illustration, similar to FIG. 2, of yet another form of needle pack in accordance with the present invention;

FIG. 26 is a cross-sectional schematic illustration taken generally along line 26—26 of FIG. 25, showing steps in the manufacture of the needle pack of FIG. 24.

DETAILED DESCRIPTION OF THE INVENTION

Figure 25:
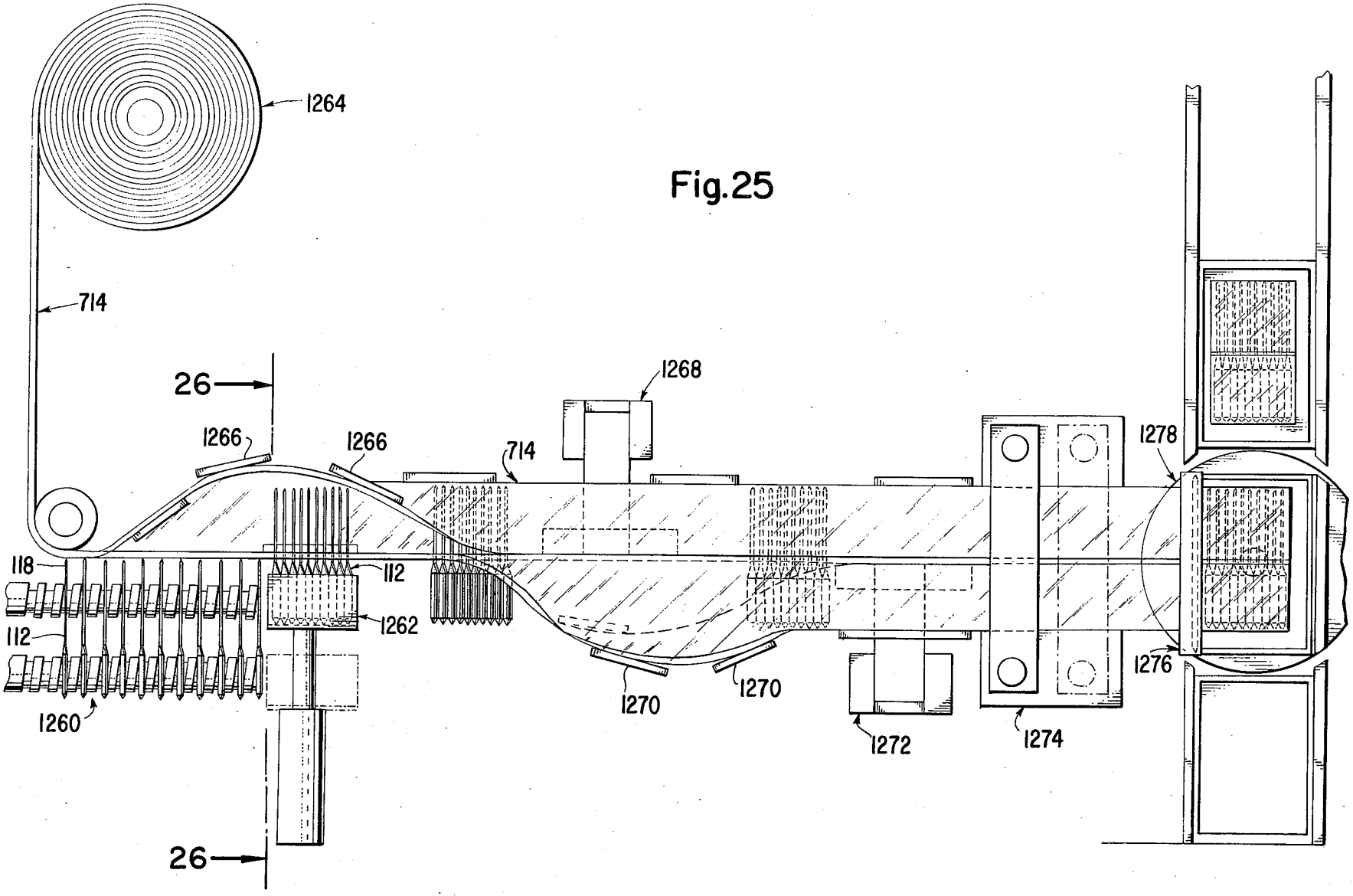
FIG. 25 is a schematic illustration of apparatus for practicing the present invention and producing the needle pack shown in FIG. 24.

With reference now to the drawing, and particularly to FIGS. 1 through 4 thereof, there is shown and illustrated a needle pack generally designated by the reference character 110 which comprises a plurality or multiplicity, for example from about 3 to about 25 sewing machine needles 112 and a wrapping of flexible or flaccid web material 114. The needles 112, which are of conventional manufacture and can be of substantially any style, size, and design, do not alone form a part of the instant invention. For use with the present invention and as a part thereof, the needles 112 need only be generally longitudinally extensive and slender, preferably comprising a generally cylindrical shank portion 116 and a reduced diameter blade portion 118 extending from the shank portion 116, being joined thereto at a shoulder or transition portion 120 which may, as shown, be of frustro-conical configuration and terminating at a point 122. Furthermore, while the invention finds especial utility with sewing machine needles, it is to be expressly understood that the present invention extends to packaging of other commodities.

The web 114 may be made of substantially any flexible or flaccid material such as paper or metalic foil and is most preferably of a film, such as a thermoplastic film or other heat sealable material. The plurality or multiplicity of needles to be packed as a unit package are assembled with the web material 114 by insertion or piercing of the needle shank portions 118 through the web of material 114, as for example, a distance until the shoulder or transition portion 120 abuts the web of material 114. The multiplicity of needles 112 is preferably arranged in a planar group, with the needles 112 being parallel with one another and pointing in the same direction and the shank portion 116 contiguous so that the points are in a single line as are the end portions of the shank portions. The web 114 may be pre-perforated for receiving the needle blades 118 or, more efficiently, the needle blades 118 may be merely driven through the web material 114 to pierce the web material 114 and thereby provide their own holes surrounded by the web 114 defining thereby a line of concatenated fenestrations. For example, and with particular reference to FIG. 4, the web of material 114 may be supported on a support surface or structure 124 having a groove or slot 126 therethrough so that the needles 112 may be inserted through the web of material 114 until the shoulders or transition portions 120 abut the film material 114 as shown in solid lines in FIG. 4, generally bisecting the web of material 114 into generally oppositely extending generally equal width panel or wing portions 128 and 130. The panel or wing portions 128 and 130 may then be wrapped tightly about the needle shanks 116, as indicated in dotted lines in FIG. 4 and the panel or wing portions 128 and 130 joined adjacent the sides of the plurality of needle shank portions as along a seal line 131 and adjacent the ends of the needle shanks 116, as along a seal line indicated generally by the reference character 132. The seals may be accomplished in substantially any desired manner, as by use of adhesives or the like, or by thermally bonding or heat sealing the film material 114 to itself. Outboard of the seal area 131 the remaining portions of the panel portions 128 and 130 define flaps 134 and 136 which may be left separated, as shown in FIG. 1 to be grasped to tear open the pack 110 although, if desired, the flaps 134 and 136 can be joined together or trimmed off, either as a part of the sealing step or as a separate step. Furthermore, the seal areas 131 and 132 may be designed to be peelable. Yet further, the presence of the flaps 134 and 136, whether left separated or sealed together, will enable the pack 110 to be stapled, or the like, to a card, or the like for handling and display.

It will be noted that the tight wrapping of the film material 114 around the contiguous needle shanks 116 provides a relatively rigid pack, since the pack cannot bend unless the material of the web 114 is stretched or distorted.

The web of material 114 may be further provided, as shown in the drawing, with a reinforcing section or rib means extending generally longitudinally thereof adjacent the line of concatenated fenestrations whereat the needle blade perforations occur. For example, a reinforcing rib or ribbon 138 may be bonded to the web of material 114, as shown. The ribbon or rib 138 is also adapted to be pierced by the needle blades 118 and provides a stop against which the needle shoulders or transition portions 120 may abut and, once pierced, defines the fenestrations. The ribbon or rib 138 may be of substantially any flexible material, similar to or different from the material forming the web 114. Most preferably, the ribbon or rib 138 is a thermoplastic film material that may be heat bonded to the web 114.

In addition to acting as a stop against which the needle transition portions 120 abut and defining the fenestrations, the rib, ribs or ribbon 138 provides additional stability to the package 110 forming, in the completed package, essentialy an I beam type of structure providing additional rigidity and resistance to stretching or elongation. Yet further, the rib, ribs or ribbon 138 provides additional resistance towards inadvertent expansion of the pierced holes and enables multiple use of the package by enabling needles to be re-inserted after being withdrawn. Still further, the rib or ribs 138 aid in holding such needles in position if removed and replaced by increasing the friction of the pack against the needle blades.

As indicated, the packages may be severed from the web of material 114 adjacent each of the fin seals 132 to provide a unit package. Moreover, it is also within the purview of the present invention to maintain a number of group packages in a single continuous web, as indicated in FIG. 5, wherein a number of serially arranged needle packs 110' separated by continuous fin sealed regions 132' are provided. Depending on the width of the fin seal regions 132', the package may be either very flexible between the needle groups or be left quite rigid. If a rigid multi-pack is desired, the seal may be designed to only minimally distort the rib 138, enabling it to rigidify the pack between the needle groups.

In the embodiment or modification shown and illustrated in FIGS. 1 through 4, only the needle shanks 116 are wrapped within the web 114. It is also within the ambit of the present invention to provide containment and protection, when desired, to the needle blades 118 and needle points 122. Accordingly, and with reference now to FIGS. 6 through 10, inclusive, there is shown and illustrated another embodiment or modification of needle pack in accordance with the principles of the present invention and designated generally by the reference character 210 wherein the needles 112 are entirely contained within a wrapping formed from a web 214 of flexible or flaccid material similar in character to the web or material 114. The web 214 is provided with a pair of longitudinally extending spaced apart ribs 238 between which the shank portion 118 of the needles 112 pierce the web 214 until the shoulders or transition portions 120 abut the ribs 238. After the web 214, and particularly an edge or wing portion 230 thereof on one side of the ribs 238 and an intermediate portion or course 228 on an opposite side of the ribs 238 is wrapped about the shank portions 116 of the needles 112, a further course 242 of the web 214 is wrapped over the web edge or wing portion 230 and about the group or multiplicity of needles 112 to the tips 122 thereof and a final edge course or wing 244 of the web of material 214 is then wrapped about the opposite side of the group or multiplicity of needles 112 and secured, as by heat bonding, or the like, to the panel portion or course 228. The ends adjacent the endmost ones of the needles 112 of the group or multiplicity of needles may then be sealed as hereinelsewhere disclosed to define the pack length.

Yet further, the web of material 214 may be provided with an auxiliary reinforcing section or needle tip protective reinforcing rib, band or ribbon 246 in spaced apart relationship to the band 238 a distance such that the tips 122 of the needles 112 abut the reinforcing band 246, as shown particularly in FIGS. 6, 7, and 10.

Various other webs of flexible material having a reinforcing section extending the length thereof may be used to wrap the needles 112. Eight webs being designated 314, 414, 514, 614, 714, 814, 914 and 1014 are shown in FIGS. 11–18, respectively. Each of the webs 314, 414, 514, 614, 714, 814, 914 and 1014 has a reinforcing section generally designated 338, 438, 538, 638, 738, 838, 938 and 1038, respectively. The web 714 (FIG. 15) additionally includes an auxiliary reinforcing section 746 extending parallel the reinforcing section 738 for wrapping and protecting the points 122 of the needle blades 118.

The reinforcing section 338 of web 314 consists of two, spaced, semicircular ribs which together with the central reinforcing web portion therebetween define a groove 350. The reinforcing section 538 of web 414 consists of two spaced, circular ribs which together with the central reinforcing web portion therebetween define a groove 450. The reinforcing section 538 of web 514 comprises an angular rib having two sides and a bight which define a groove 550. The reinforcing section 638 of web 614 comprises two opposing, C-shaped ribs each of which defines a groove 650. The reinforcing section 738 of web 714 comprises two, spaced, circular ribs which together with the web portion therebetween define a groove 750 in the same manner as reinforcing section 338 of web 314. The auxiliary reinforcing section 748 of web 714 comprises a thermoplastic, V-shaped rib. The auxiliary reinforcing section 838 of web 814 comprises a raised generally rectangular band or tape like portion having a laterally concave groove on the upper surface. The reinforcing section 938 of web 914 has a grooved band or tape like the band 838 on both sides of the web and the reinforcing section 1038 is a flat band. Of course, any of the reinforcing sections may be integrally formed, as by extrusion with the respective web or may be separately formed and attached to the respective web as a separate operation, as by being bonded thereto, for example by heat bonding, adhesive bonding, or the like. The auxiliary reinforcing sections may also be extruded, for example as a hot melt, onto a previously formed web.

Finally, and with reference now to FIGS. 19 through 21, inclusive, a thermo-plastic web 1114 may be folded and heat formed or re-formed to provide an integral auxiliary reinforcing section 1138 of any desired cross section such as, as shown in FIG. 21, a section comprising smoothly curved outer and inner surfaces 1150 and 1152, respectively, the outer surface being generally convex and the inner surface comprising a central generally concave groove bordered on either side by a generally convex thickened rib 1154. As illustrated and shown, the auxiliary reinforcing section 1138 may be formed by first folding a medial portion of the thermoplastic web into a longitudinally extending Z-fold 1138'. The Z-folded section now defines the reinforcing rib and may be adhesive or heat bonded if desired. Further, the rib may be re-formed by pressing the Z-folded section between mating heated re-forming dies 1156 and 1158 shaped to provide the desired curved outer and inner surfaces 1150 and 1152, respectively, as shown and illustrated in FIG. 20. For continuous processing, the dies 1156 and 1158 may be in the form of wheels or rollers carrying the contours of the curved surfaces 1150 and 1152 on their peripheries. The dies 1156 and 1158 are heated by means (not shown) to a temperature sufficient to at least soften the thermo-plastic web 1114 and mold and bond the successive courses of the Z-folded section 1138' to the desired final configuration 1138 shown and illustrated in FIG. 21.

As heretofore pointed out, and as indicated, for example, in connection with the description of FIG. 5, it is within the ambit of the present invention to provide the needle packs as either unitary packs severed from the continuous web of material or as groups of needle packs distributed as a unit. For example, if the needle packs each contain 10 needles, 10 needle packs may be distributed as a unit without being severed from the other to define a package of 100, the presently conventional number of needles distributed as a unit for industrial sewing purposes. If the packs each contain 20 needles, 5 needle packs can be retained as a single strip, again to provide a conventional industrial sewing machine needle package of 100 needles. Yet further, generally rigid packs of, for example, 25 needles in groups of 5 with the fins between the groups being generally stiff may be produced. These packs may then be packed, 4 to a box, to make up a box of 100 needles.

Furthermore, as heretofore pointed out, the needle packs of the present invention are, although made of flexible of flaccid packaging material, generally rigid due to the interaction of the flexible or flaccid packing material with the needles themselves, particularly the contiguous needle shanks 116. However, the web of material remaining between adjacent needle packs may and a contiguous serially arranged string of needle packs may remain bodily flexible or flaccid so that, and with reference now to FIG. 22, the serially arranged needle packs, such as the needle pack 110 may be Z-folded and packed, for example, within a box 152 for storage, handling and distribution. The bent fin seals may provide for accommodation of different size needles in a common box size and may provide endwise cushioning of the packs within the box. Yet still further, the web 132 intermediate the needle pack 110 may be preliminarily weakened, as by lines of perforation 154, as shown in FIG. 23 so that the needle packs 110 may be easily separated one from the other by the user. Further, additional lines of preliminary weakening or perforations may be provided to enable the needle packs to be easily opened by the user.

With reference now to FIG. 24, there is shown and illustrated yet another needle pack designated generally by the reference character 1210 constructed from a further plastic web of the type shown in FIG. 15. The needles 112 are arranged with their shank portions 116 contiguous one another end and the blade portions 118 of each of the plurality of needles 112 pierces and bisects the reinforcing section 738 of the web 714 to the juncture of the blade portion 118 with the shoulder or transition portion 120. The portion of the web 714 on the side of the reinforcing section 738 provided with the auxiliary reinforcing section 748 is wrapped tightly around the needle blade portions 118 with the needle tips 122 within the auxiliary reinforcing section 748 and the edge of the web is secured to the other side of the reinforcing section 738, as by heat bonding, or the like. The portion of the web 714 on the other side of the reinforcing section 738 is wrapped around the needle shank portions 116 and secured to said one side of the reinforcing section 738.

The needle packs of the instant invention are particularly suited for mechanized packaging. Accordingly, there is seen in FIGS. 25–26 an automated method of and apparatus for making the needle pack 1210 seen in FIG. 24. A stop and go screw feed 1260 provides a continuous supply of needles 112 to a reciprocating feed box 1262, which in turn moves the needles 112 toward the moving web 714 continuously supplied by a web coil 1264. Rectilinear motion of the feed box 1262 toward the moving web 714 causes the blade portions 118 of each of the closely spaced needles 112 in the feed box 1262 to penetrate the central reinforcing web portion 738 of the web 714. Guides plates 1266 wrap one side of the web 714 around the needle blades 118 and a welding device 1268 secures said one side of the web 714 to the reinforcing rib section 738. Then, in similar fashion, guide plates 1270 wrap the other side of the web 714 around the needle shanks 116 and a second welding device 1272 secures the other side of the web 714 to the reinforcing rib section 738.

A transporting unit 1274 then carries the wrapped needles to a transverse seaming device and cutter 1276. The seaming device and cutter 1276 separates adjacent groupings of needles, and effectively creates the generally rigid needle pack 10 which is then moved into a tray 1278 for final disposition. A turntable 1278 may be provided to reverse alternate needle packs for better stacking with alternating layers of needles pointing in opposite directions. Size, brand name, and other identifying information may be printed on the web if desired.

Various changes and modifications may be made without departing from the spirit and scope of the present invention, and it is intended that such obvious changes and modifications be embraced by the annexed claims.

I claim:

1. Needle pack comprising:

a web of flexible material; and a plurality of needles, each of which has a generally cylindrical shank portion and a blade portion of generally reduced cross section extending generally longitudinally outward of an end of said shank portion and terminating in a point portion, said plurality of needles being generally parallel and disposed in generally planar relationship with said shank portions contiguous one another to thereby dispose said reduced cross-section blade portions in generally parallel spaced apart relationship, each of said blade portions piercing said web along a generally straight line of concatenated fenestrations contiguously framing each of said blade portions;

at least one reinforcing rib extending along said line of fenestrations and pierced by said blade portions;

said web being wrapped generally tightly around said contiguous shank portions and tightly sealed therearound, binding said plurality of needles tightly together to thereby provide a generally rigid pack of needles.

2. Needle pack defined in claim 1 wherein said line of concatenated fenestrations generally longitudinally bisects said web defining a pair of opposed edge panel portions of generally equal width, said edge panel portions being folded adjacent opposite sides of said shank portions of said plurality of needles and joined to each other along a seam extending generally adjacent the endmost ones of said plurality of needles and the end portions of said needle shank portions opposite said blade portions.

3. Needle pack defined in claim 1 wherein a signle course of said web extending outwardly of one side of said line of concatenated fenestrations extends along one side of the contiguous shank portions of said plurality of needles, around the end portions thereof opposite said blade portions, and along the other side of the contiguous shank portions and is sealed generally adjacent the endmost ones of said plurality of needles and the other side of said line of concatenated fenestrations to define a continuous band enclosing said shank portions.

4. Needle pack defined in claim 3 wherein another single course of said web extending outwardly of said other side of said line of concatenated fenestrations extends along one side of the parallel spaced apart blade portions of said plurality of needles, around the point portions thereof, and along the other side of the parallel spaced apart blade portions and is sealed to said first mentioned single course of said web generally adjacent said line of concatenated fenestrations to define a continuous band enclosing said blade and point portions of said plurality of needles.

5. Needle pack defined in claim 1 wherein said line of concatenated fenestrations is offset from the center line of said web, being closer to one side edge thereof than the other defining relatively narrow and wide edge panel portions of said web, respectively, said narrow edge panel portion of said web being folded to extend along one side of the contiguous shank portions of said needles, said wide edge panel portion being folded tightly around said plurality of needles to define a first course folded alongside the contiguous shank portion, a bend around the end portion of the contiguous shank portions, a second course closely overlying said narrow edge panel portion and extending alongside the blade portions on one side of said needles, a second bend around the blade points, and a third course extending alongside at least the blade portions on the other side of said needles and sealed to said first course.

6. Needle pack defined in claim 1 wherein said rib comprises a Z-folded portion of the web.

7. Needle pack defined in claim 6 wherein said web is thermo-plastic, said Z-folded portion being heat sealed and molded to define a pair of thickened portions one on each side of said line of fenestrations.

8. Needle pack defined in claim 1 further comprising an auxiliary reinforcing rib engaging the points of said needles.

9. Needle pack defined in claim 1 further comprising a further plurality of needles similarly enclosed by said web defining a continuous belt of packaged needles.

10. Needle pack defined in claim 1 wherein said plurality of needles comprises from about 3 to about 25 needles.

11. A needle pack according to claim 9 which provides that needles are packed up in continuous belt arrangement of which small predetermined quantity units are cut-off for further packaging in boxes or on cards.

12. A needle pack according to claim 11 where said small predetermined quantities of needles can be separated from a continuous belt arrangement by means of pull-off-impressions formed in the web between said small predetermined quantities of needles and where these separated quantities can also be used as individual units.

13. Method of packaging a plurality of sewing machine needles comprising, grouping said plurality of needles generally parallel one another with the shank portions thereof contiguous and the blade portions thereof in a generally common plane so that the point portions thereof are in a generally straight line, guiding a reinforcing rib and a web of flexible material contiguous to the point portions of said needles, piercing the blade portions of said grouped needles through said reinforcing rib and through an intermediate portion of said web of flexible material to form a line of concatenated fenestrations, tightly wrapping said web around at least said contiguous shank portion of said needles, and sealing said web at least generally adjacent said contiguous shank portion to thereby define a generally rigid package.

14. Method defined in claim 13 further comprising, tightly wrapping said web also around the blade portions of said needles to enclose and protect them.

* * * * *